US011370624B2

(12) United States Patent
Uchida

(10) Patent No.: US 11,370,624 B2
(45) Date of Patent: Jun. 28, 2022

(54) IMAGE FORMING APPARATUS

(71) Applicant: CANON KABUSHIKI KAISHA, Tokyo (JP)

(72) Inventor: Yuki Uchida, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 16/987,508

(22) Filed: Aug. 7, 2020

(65) Prior Publication Data

US 2021/0070567 A1 Mar. 11, 2021

(30) Foreign Application Priority Data

Sep. 5, 2019 (JP) ..... JP2019-161729

(51) Int. Cl.

| | |
|---|---|
| ***B65H 3/66*** | (2006.01) |
| ***B65H 3/06*** | (2006.01) |
| ***B65H 1/26*** | (2006.01) |

(52) U.S. Cl.

CPC ..... *B65H 3/66* (2013.01); *B65H 1/266* (2013.01); *B65H 3/0638* (2013.01); *B65H 3/0676* (2013.01); *B65H 2401/115* (2013.01); *B65H 2401/222* (2013.01); *B65H 2402/32* (2013.01); *B65H 2601/324* (2013.01)

(58) Field of Classification Search

CPC . B65H 1/04; B65H 1/26; B65H 1/266; B65H 3/06; B65H 3/0638; B65H 3/0684; B65H 3/66; B65H 3/68; B65H 2401/115; B65H 2401/222; B65H 2402/32; B65H 2601/324

See application file for complete search history.

(56) References Cited

U.S. PATENT DOCUMENTS

| | | | |
|---|---|---|---|
| 5,700,006 | A | 12/1997 | Sekiya et al. |
| 5,765,826 | A | 6/1998 | Isoda et al. |
| 6,527,267 | B1 | 3/2003 | Kuwata et al. |
| 6,643,480 | B2 | 11/2003 | Kuwata et al. |
| 6,830,245 | B2 | 12/2004 | Matsushima et al. |
| 6,871,848 | B2 | 3/2005 | Matsushima et al. |
| 7,029,006 | B2 | 4/2006 | Izumi et al. |
| 7,130,548 | B2 | 10/2006 | Uchida |

(Continued)

FOREIGN PATENT DOCUMENTS

| | | |
|---|---|---|
| JP | 2007-126228 A | 5/2007 |
| JP | 2015-221707 A | 12/2015 |

*Primary Examiner* — Prasad V Gokhale

(74) *Attorney, Agent, or Firm* — Venable LLP

(57) ABSTRACT

An image forming apparatus has: a cassette which stores a sheet; a pickup roller which picks up the sheet inside the cassette; a feed roller which feeds the sheet picked up by the pickup roller toward an image forming portion; and a retard roller which is pressed against the feed roller and forms a separation nip. In addition, the image forming apparatus has a conveying guide which guides the sheet picked up by the pickup roller to the separation nip. A first guide member of the conveying guide is configured to be slidable in a drawing direction when the feed roller is replaced, and the conveying guide is formed of a material whose property of light transmittance of light having a wavelength of 360 nm to 420 nm is 80% or more. The feed roller is detachable from the one end of a shaft in a state in which the cassette is drawn out along the rail and the conveying guide is slid in the drawing direction.

5 Claims, 13 Drawing Sheets

(56) References Cited

U.S. PATENT DOCUMENTS

| | | | | |
|---|---|---|---|---|
| 2016/0282788 | A1* | 9/2016 | Itabashi | B65H 5/36 |
| 2017/0060066 | A1* | 3/2017 | Fujita | B65H 3/66 |
| 2020/0073317 | A1 | 3/2020 | Uchida | |
| 2020/0301340 | A1* | 9/2020 | Fujimoto | G03G 15/6502 |

* cited by examiner

IMAGE FORMING APPARATUS

BACKGROUND OF THE INVENTION

Field of the Invention

The present invention relates to an image forming apparatus which forms an image on a sheet fed from a cassette.

Description of the Related Art

Conventionally, on image forming apparatuses such as printers, facsimile apparatuses, and copying machines, sheet feeding devices, which feed stacked sheets to image forming portions are mounted in general. Each of the sheet feeding devices is configured such that stacked sheets are fed by a pickup roller and are conveyed in such a way as to separate the sheets one by one between a feed roller, which rotates in the same direction as a sheet feeding direction, and a retard roller, which is pressed against the feed roller by a spring.

However, when in each of the above-mentioned sheet feeding devices, abrasion of the rollers develop due to enduring, failure in conveyance of the sheets is caused. Therefore, as disclosed in each of Japanese Patent Laid-Open No. 2015-221707 and Japanese Patent Laid-Open No. 2007-126228, the rollers are configured to be replaceable.

In Japanese Patent Laid-Open No. 2015-221707, a conveying guide which guides a sheet conveyed by a conveying roller is provided to be movable in an axial direction of a driving shaft of the conveying roller, and the conveying roller is accessible by this movement of the conveying guide in the axial direction.

In Japanese Patent Laid-Open No. 2007-126228, a guiding plate which guides conveyance of a sheet is supported by a device main body in an openable and closable manner, and by opening the guiding plate, a working space for attaching and detaching a sheet feeding roller to and from a driving shaft is exposed.

In a case of a configuration in which upon replacing the roller, a cassette which stores sheets is drawn out from an image forming apparatus and the roller is visually recognized from a space formed by drawing out the cassette, it is difficult to find the roller since the roller is hidden by the conveying guide. This is because it is required to make the conveying guide approach to a nip position of the rollers. In general, the larger a distance between the nip position of the rollers and a sheet guiding surface of the conveying guide is, the more easily failure in feeding is caused when a leading edge of a sheet is brought in contact with a peripheral surface of the roller. Therefore, the distance between the nip position of the rollers and the sheet guiding surface of the conveying guide is designed as small as possible. In positional relationship therebetween, only a slight range of the roller, which comes out of the conveying guide, can be visually recognized from the space formed by detaching the cassette housing the sheets as described above.

SUMMARY OF THE INVENTION

The present invention provides a unit which allows a roller targeted for replacement to be easily visually recognized.

An image forming apparatus according to the present invention includes:

an image forming portion which forms an image on a sheet;

a cassette which stores a sheet;

a pickup roller which picks up the sheet inside the cassette;

a feed roller which feeds the sheet picked up by the pickup roller toward the image forming portion and is attached to one end of a shaft;

a separation member which is provided in a position facing the feed roller, forms a separation nip by being pressed against the feed roller, and separates a plurality of sheets picked up by the pickup roller one by one at the separation nip;

a rail which supports the cassette and along which the cassette is drawn in a drawing direction orthogonal to a conveying direction; and a conveying guide which guides the sheet picked up by the pickup roller to the separation nip, the conveying guide including:

a first guide member which is located above the separation nip in a vertical direction and is located further downstream of the cassette in a drawing direction than the feed roller;

a second guide member which is located above the separation nip in the vertical direction and is located further upstream of the cassette in the drawing direction than the feed roller; and a third guide member which is located below the separation nip in the vertical direction and is located in a position where the third guide member overlaps with the feed roller in the drawing direction, the first guide member being configured to be slidable in the drawing direction when the feed roller is detached from the shaft and being formed of a material whose property of light transmittance of light having a wavelength of 360 nm to 420 nm is 80% or more, each of the second and third guide members being formed of a material whose light transmittance of the light having the wavelength of 360 nm to 420 nm is less than 80%, the feed roller being detachable from the one end of the shaft in a state in which the cassette is drawn out along the rail and the first guide member is slid in the drawing direction.

Further features of the present invention will become apparent from the following description of exemplary embodiments with reference to the attached drawings.

DESCRIPTION OF THE EMBODIMENTS

Hereinafter, with reference to the attached drawings, an exemplary embodiment of the present invention will be described in detail in an illustrative manner. However, dimensions, materials, shapes, and relative arrangement of components described in the below embodiment are to be appropriately modified based on a configuration of an apparatus and a variety of conditions to which the present invention is applied and are not intended to limit the present invention thereto merely.

[Image Forming Apparatus]

Figure 1:
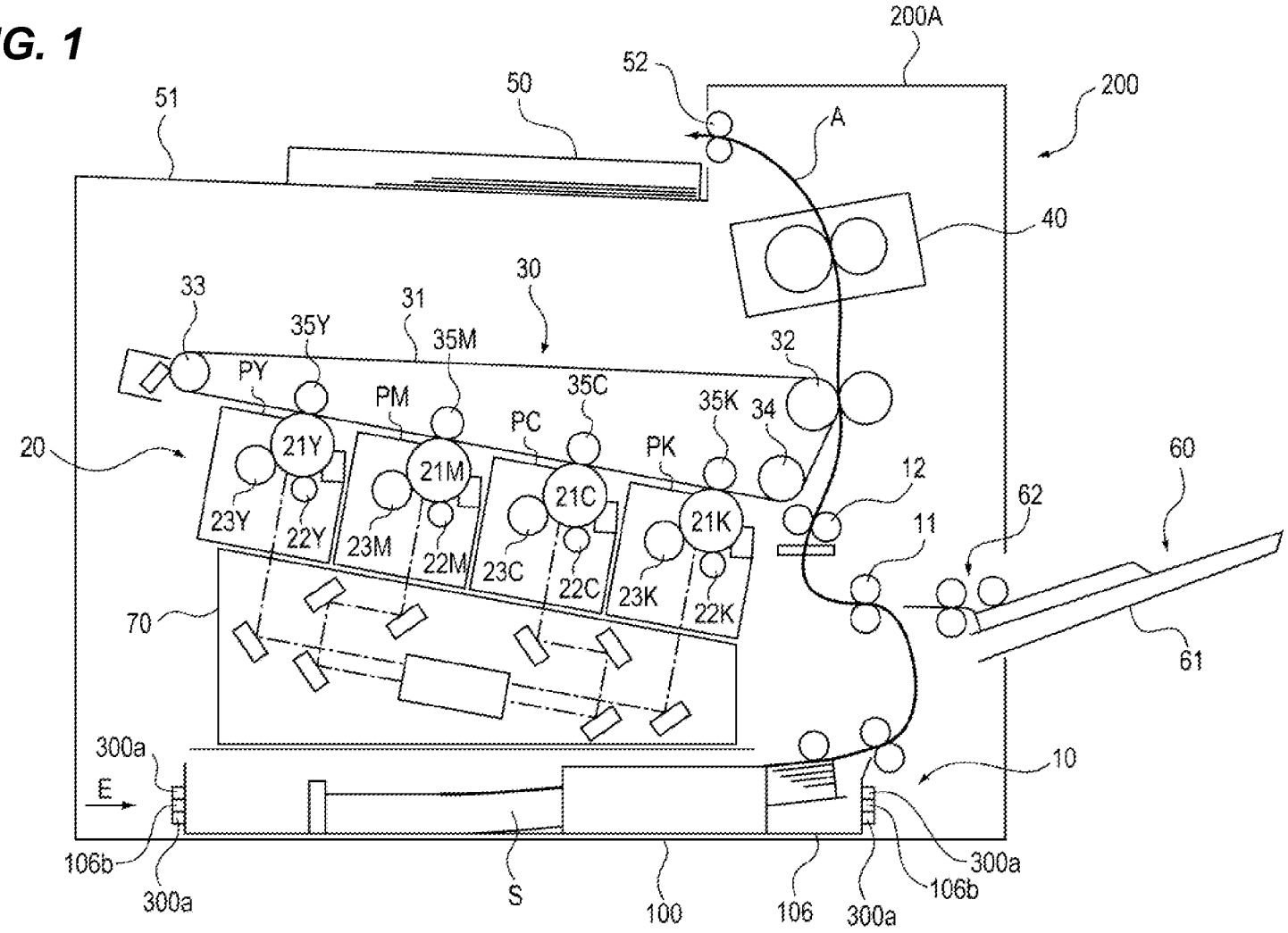
FIG. 1 is a schematic cross-sectional view showing an image forming apparatus.

With reference to FIG. 1, one example of an image forming apparatus according to the present embodiment will be described. Here, as the one example of the image forming apparatus, a color image forming apparatus of an intermediate transfer system using an electrophotographic system is illustrated. FIG. 1 is a cross-sectional view of the image forming apparatus including a sheet feeding device according to the present embodiment.

The image forming apparatus 200 includes: an image forming portion 20 which forms an image on a sheet; a fixing portion 40 which fixes the image on the sheet; a sheet discharging portion 50 which discharges the sheet on which the image is fixed; and sheet feeding portions 100 and 60, each of which feeds the sheet to the image forming portion 20. As the sheet feeding portions, a sheet feeding portion 100 which is located in a lower portion of an apparatus main body 200A and a multi-feeding portion 60 which is located in one of side portions (a right side portion in FIG. 1) of the apparatus main body 200A are included. The sheet feeding portion 100 will be described in detail later.

The image forming portion 20 is an image forming portion of the so-called 4-drum full-color system, which includes a laser scanner 70, four process cartridges P, and an intermediate transfer portion 30. These process cartridges P form toner images having respective colors of yellow (Y), magenta (M), cyan (C), and black (K). The process cartridges P (PY, PM, PC, and PK) include photoconductor drums 21 (21Y, 21M, 21C, and 21K), charging devices 22 (22Y 22M, 22C, and 22K), and development devices 23 (23Y, 23M, 23C, and 23K), and a cleaning device, not shown. It is to be noted that the process cartridges P have the same configurations as one another except that toner colors thereof are different from one another.

The intermediate transfer portion 30 has an intermediate transfer belt 31 which is wound on a driving roller 32, a driven roller 33, and a tension roller 34. The intermediate transfer belt 31 is located above the four process cartridges P (PY, PM, PC, and PK). The intermediate transfer belt 31 is located in such a way as to contact the photoconductor drums 21 of the process cartridges P and is rotatably driven in a counterclockwise direction by the driving roller 32 driven by a driving portion, not shown. The intermediate transfer portion 30 includes primary transfer rollers 35 (35Y, 35M, 35C, and 35K) in positions facing the photoconductor drums 21, the primary transfer rollers 35 abutting against an inner peripheral surface of the intermediate transfer belt 31, and as nip portions each between the intermediate transfer belt 31 and the photoconductor drums 21, primary transfer portions are formed. In addition, the image forming portion 20 includes a secondary transfer roller 36 in a position facing the driving roller 32, the secondary transfer roller 36 abutting against an outer peripheral surface of the intermediate transfer belt 31. As a nip portion between this secondary transfer roller 36 and the intermediate transfer belt 31, a secondary transfer portion where a toner image carried on the intermediate transfer belt 31 is transferred onto the sheet is formed.

In the process cartridges P configured as described above, on surfaces of the photoconductor drums 21, an electrostatic latent image is drawn by the laser scanner 70 and thereafter, toner is supplied from each of the development devices 23, thereby forming toner images charged with negative polarity and having the respective colors. A transfer bias voltage of positive polarity is applied to each of the primary transfer rollers 35 and on the primary transfer portions, these toner images are thereby sequentially multiple-transferred (primary-transferred) to the intermediate transfer belt 31, thereby forming a full-color toner image on the intermediate transfer belt 31. In parallel with the above-described processes of forming the toner images, the sheet fed from the sheet feeding portion 100 or the multi-feeding portion 60 is conveyed toward a pair of registration rollers 12 by a pair of conveying rollers 11, and skew feeding of the sheet is corrected by this pair of registration rollers 12. At timing coinciding with timing at which the full-color toner image formed on the intermediate transfer belt 31 is transferred, the pair of registration rollers 12 convey the sheet S to the secondary transfer portion. A transfer bias voltage of positive polarity is applied to the secondary transfer roller 36, whereby the toner image carried on the intermediate transfer belt 31 is secondary-transferred onto the sheet on the secondary transfer portion. The sheet S onto which the toner image is transferred is heated and pressurized by a pair of fixing rollers 41 in the fixing portion 40 and a color image is fixed onto the sheet. The sheet S having the image fixed thereon is discharged to a discharge tray 51 by a pair of discharging rollers 52 in the sheet discharging portion 50 located downstream from the fixing portion and is stacked. It is to be noted that an arrow A in FIG. 1 indicates a conveyance path along which the sheet fed from the sheet feeding portion 100 travels up to when the sheet is discharged to the discharge tray 51 of the sheet discharging portion 50.

In addition, when an irregular sized sheet is used, the irregular sized sheet is fed by the multi-feeding portion 60. Specifically, the irregular sized sheet is set to a multi-tray 61. The sheet set to the multi-tray 61 is fed by multi-feeding rollers 62 and thereafter, is conveyed to the pair of conveying rollers 11, whereby an image is formed thereonto by conducting the same processes as those in a case in which the sheet is fed from the sheet feeding portion 100, and the irregular sized sheet is discharged to the discharge tray 51.

[Sheet Feeding Portion]

Figure 2:
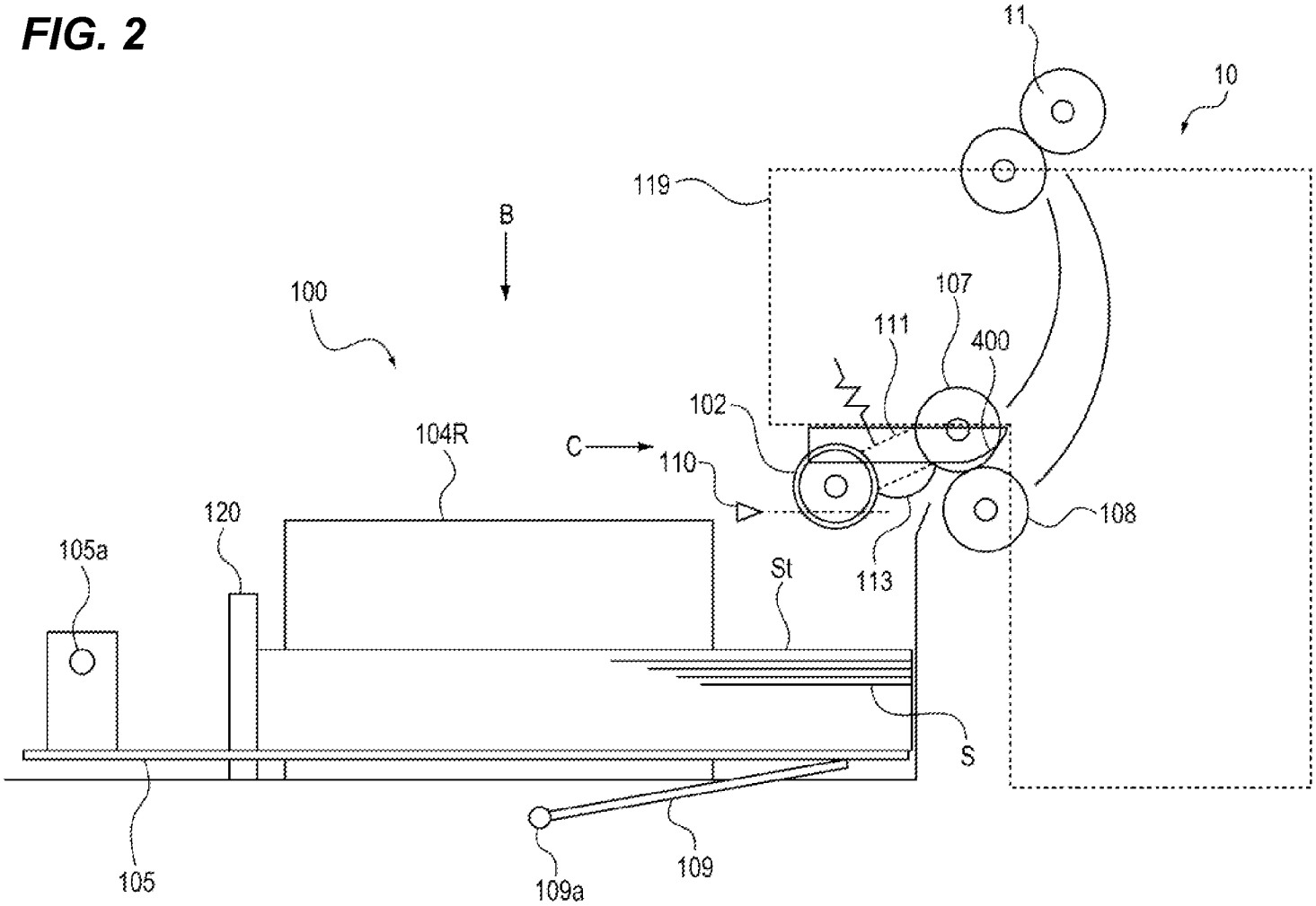
FIG. 2 is a schematic view showing a sheet feeding device.
Figure 3:
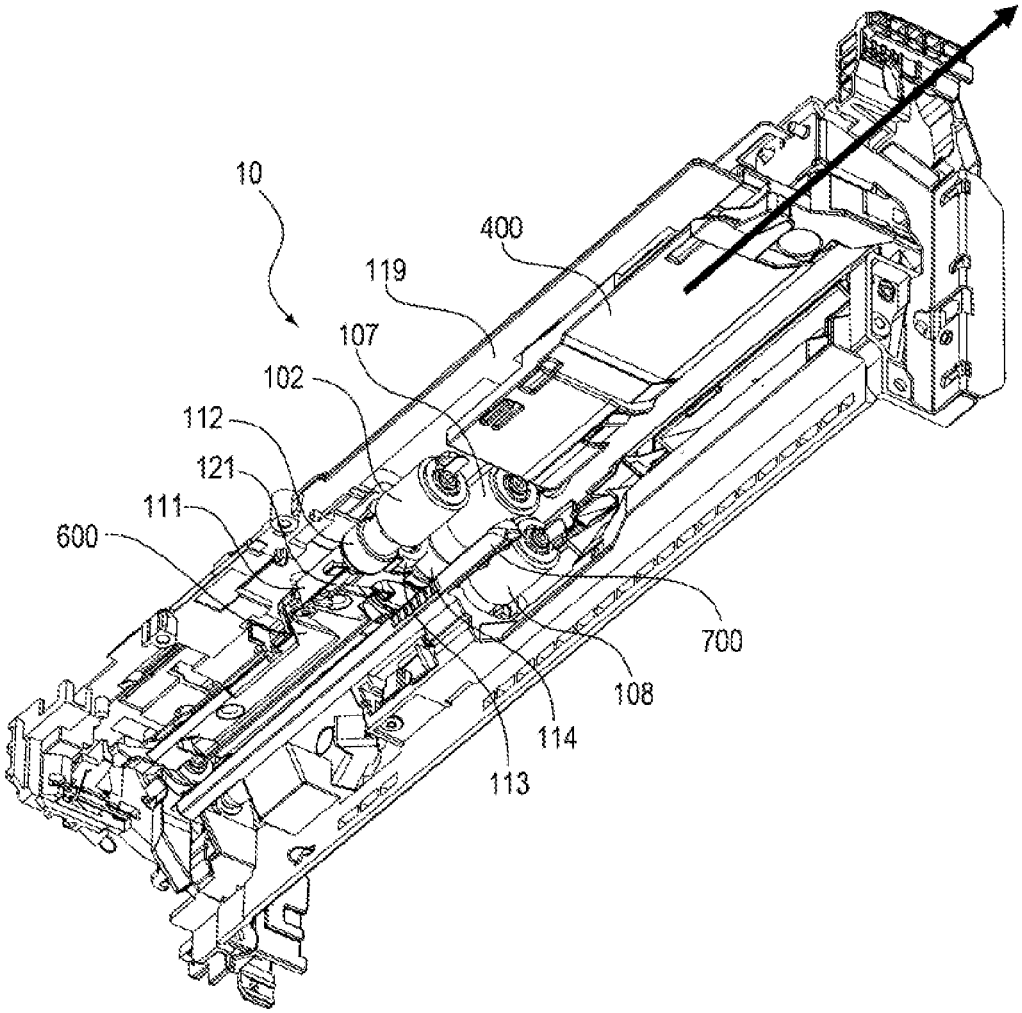
FIG. 3 is a perspective view showing a configuration of a feeding unit in a sheet feeding portion.
Figure 4:
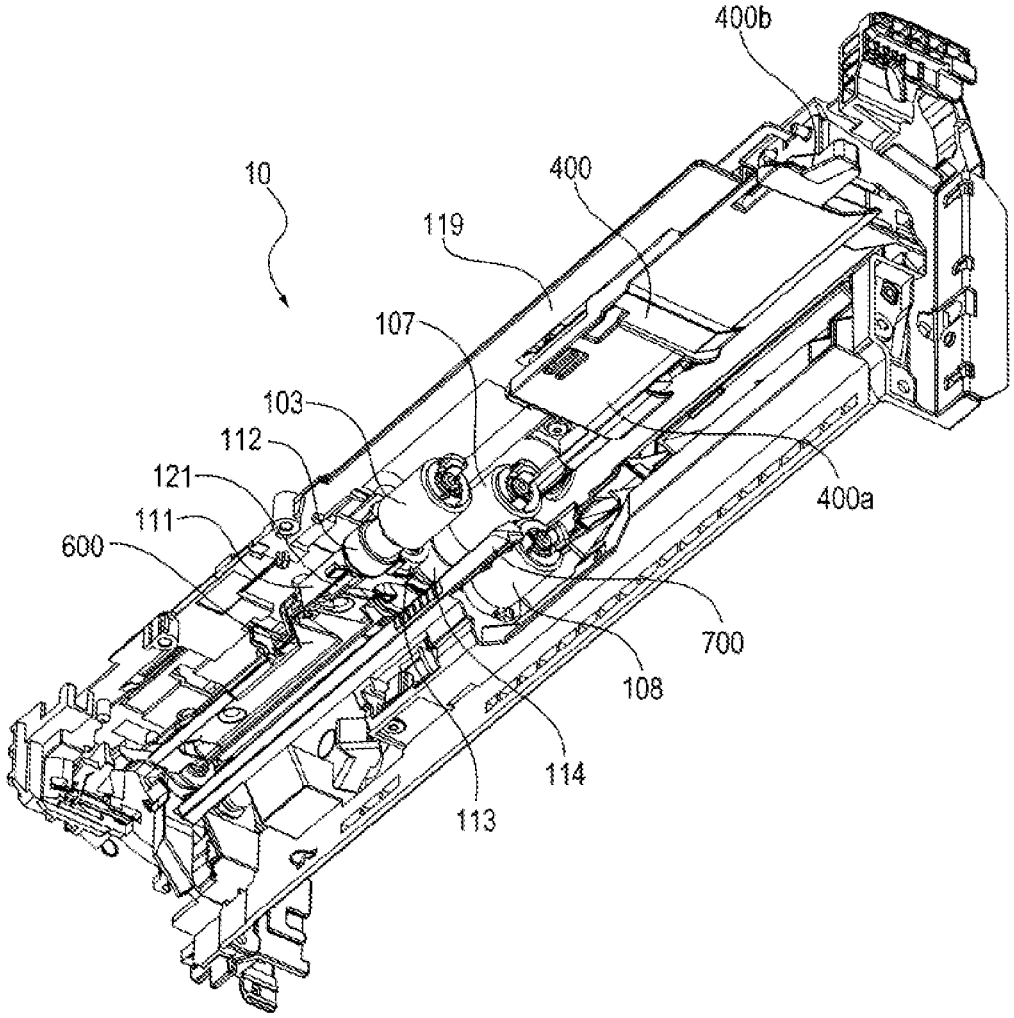
FIG. 4 is a perspective view showing a configuration of the feeding unit in the sheet feeding portion.
Figure 12:
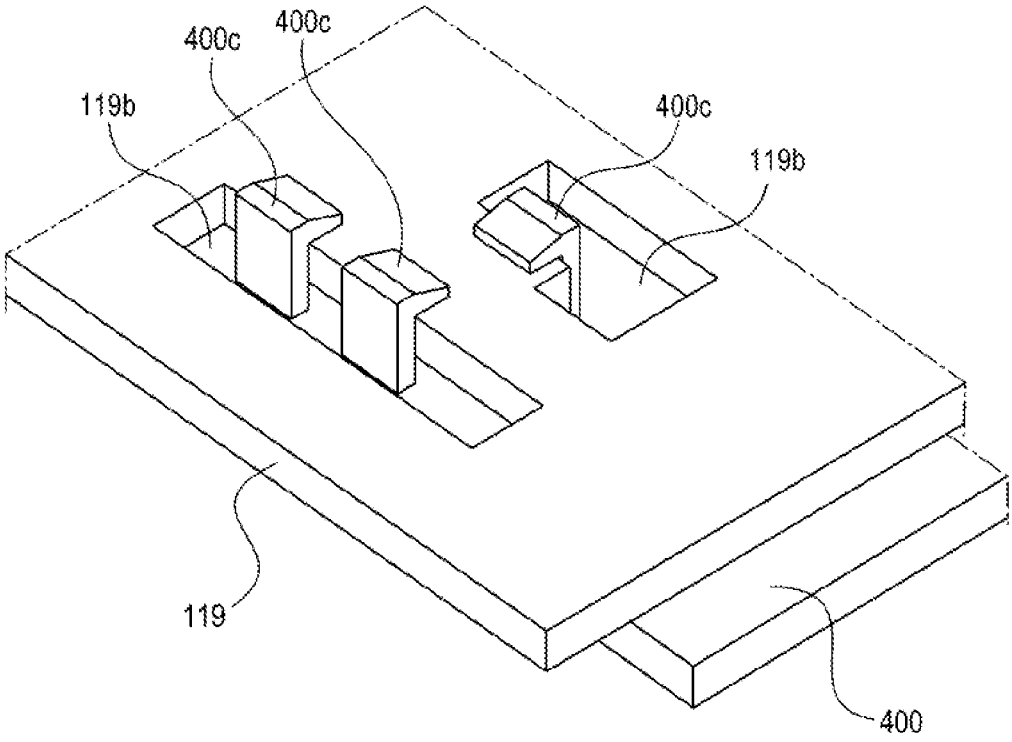
FIG. 12 is a perspective view showing positional relationship of a conveying guide and a feeding portion frame.

With reference to FIGS. 1, 2, 3, 4, and 12, a sheet feeding portion as one example of a sheet feeding device according to the present embodiment will be described. FIG. 2 is a schematic explanatory diagram showing the sheet feeding portion according to the present embodiment. FIGS. 3 and 4 are perspective views showing a configuration of a feeding unit in the sheet feeding portion. FIG. 12 is a perspective view showing positional relationship of a conveying guide and a frame of the feeding unit.

The sheet feeding portion 100 is provided in a manner drawable in a drawing direction orthogonal to a sheet feeding direction with respect to an apparatus main body 200A and includes a storage 106 which stores a sheet S and a feeding unit 10 which feeds the sheet S from the storage 106 toward an image forming portion 20.

The storage 106 is provided with a tray 105 which can lift and lower and a tray lifting and lowering plate 109 for lifting and lowering the tray 105. Drive is transmitted to the tray lifting and lowering plate 109 by a tray lifting and lowering motor and a drive transmission portion, which are not shown, whereby the tray lifting and lowering plate 109 rotates with a rotation center 109*a* as a center and lifts up the tray 105. The tray 105 is configured to rotate with a rotation center 105*a* as a center.

The feeding unit 10 has a pickup roller 102 which feeds the sheet inside the storage 106 and a feed roller 107 which feeds the sheet fed by the pickup roller 102. In addition, the feeding unit 10 has a retard roller 108 as a separation member which forms a separation nip together with the feed roller 107 to separate sheets one by one and conveying guides 400, 600, and 700 which guide the sheet to the separation nip. In the vicinity of the pickup roller 102, a detection sensor 110 for detecting a height (position) of a sheet surface St of an uppermost sheet of sheets S stacked on the tray 105 is located. It is to be noted that although in the present embodiment, the retard roller 108 is described as one example of the separation member, the present invention is not limited thereto, and for example, a separation pad can also be applied as the separation member.

The feed roller 107 is supported by one end of a driving shaft 117, in a detachably attachable manner, whose other end is supported by a feeding frame 119 provided in the apparatus main body 200A. The pickup roller 102 is located on a further upstream side than the feed roller 107 in the sheet feeding direction. The pickup roller 102 is supported by, in a detachably attachable manner, one end side of a supporting shaft 121 supported by the lifting and lowering plate 111. The lifting and lowering plate 111 is supported by the driving shaft 117 which supports the feed roller 107. In addition, the lifting and lowering plate 111 has a second guide member 600 as a conveying guide which guides a sheet fed from the pickup roller 102 to the separation nip. The retard roller 108 as the one example of the separation member is located in a position facing the feed roller 107 and forms the separation nip together with the feed roller 107. When a plurality of sheets is fed by the pickup roller 102, the retard roller 108 separates the sheets one by one together with the feed roller 107.

The first guide member 400 which constitutes the conveying guide is located between the pickup roller 102 and the feed roller 107 in a conveying direction and is located on a further downstream side than the pickup roller 102, the feed roller 107, and the retard roller 108 in the drawing direction of the storage 106. In other words, the first guide member 400 is located in a position shifting to a side of the drawing direction of the cassette 106 from the rollers 102, 107, and 108. The first guide member 400 is configured to be slidable in the drawing direction in an internal space of the apparatus main body from which the storage 106 is drawn out, in order to detach the pickup roller 102 and the feed roller 107 from the driving shaft 117. As shown in FIG. 4, the first guide member 400 has a guide portion 400*a* which has a guiding surface guiding the conveyed sheet to the separation nip and is a portion rubbed with the sheet and a handle portion 400*b* operated by a user. In addition, as shown in FIG. 12, hook portions 400*c* provided for the first guide member 400 are supported by slide holes 119*b* provided for the feeding frame 119 of the feeding unit 10. The slide holes 119*b* are extended in an axial direction of the feed roller 107, and the first guide member 400 is slidably movable in the axial direction by an opening width of each of the slide holes 119*b* with respect to the feeding frame 119. The first guide member 400 is slid from a guide position shown in FIG. 3 to a retract position shown in FIG. 4, whereby a space (space 501 shown in FIG. 11C) is formed between the first guide member 400 and the rollers and it is made possible to replace the rollers (the feed roller 107 and the pickup roller 102). It is to be noted that in the present embodiment, the first guide member 400 is configured to be slidable with respect to the feeding frame 119. However, the present invention is not limited to this, and for example, the first guide member 400 may be configured to be detachably attachable with respect to the feeding frame 119. In addition, in order to enhance visibility of the rollers 102 and 107, the first guide member 400 is formed of acrylic resin whose light transmittance of light having a wavelength of 360 nm to 420 nm is 80% or more.

Figure 9:
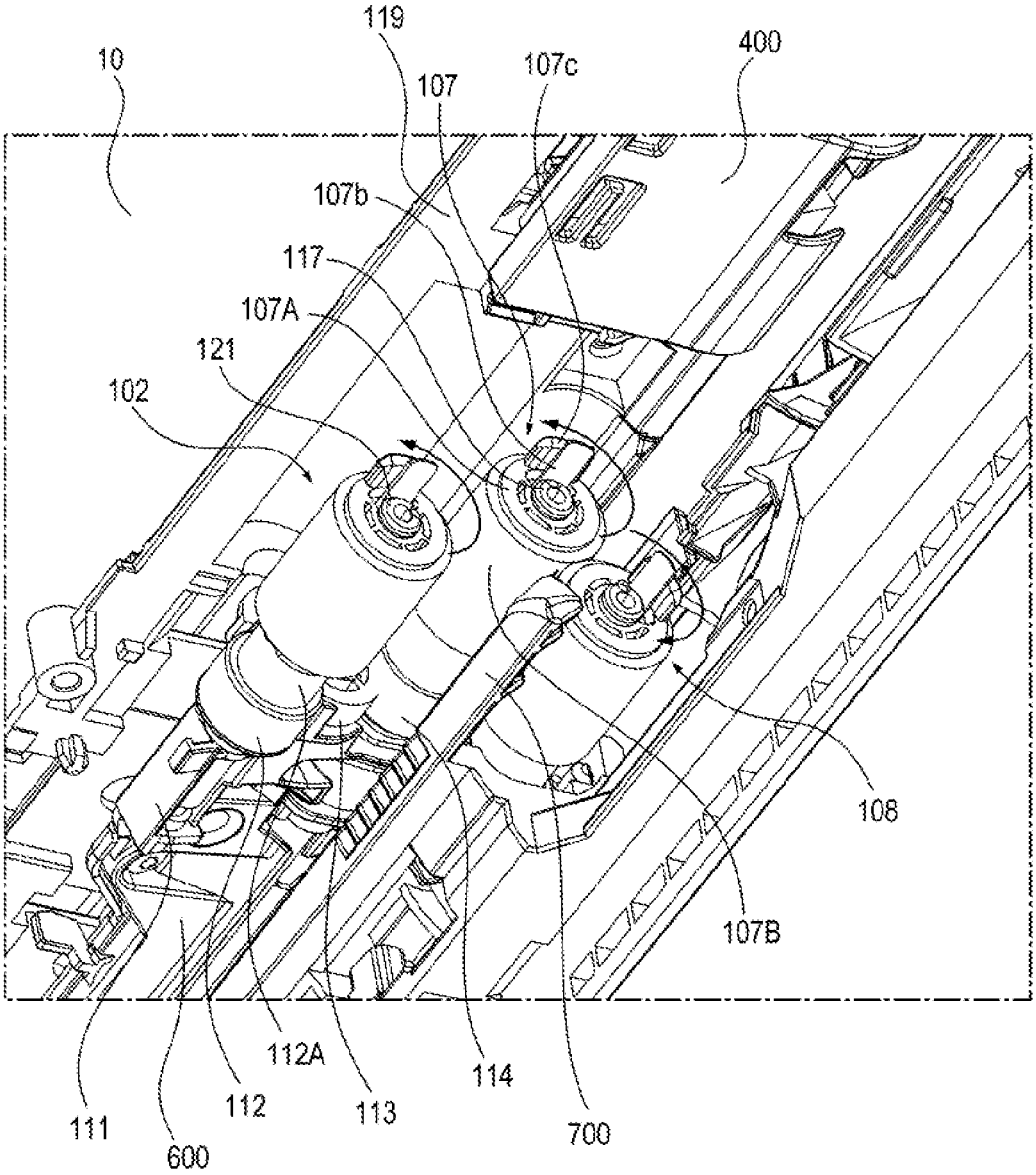
FIG. 9 is a perspective view showing a configuration of the vicinity of rollers in the feeding unit.

In addition, as shown in FIGS. 3, 4, and 9, the sheet feeding portion 100 is provided with the second guide member 600 and the third guide member 700, each of which constitutes the conveying guide for guiding the sheet picked up by the pickup roller 102 to the separation nip. Unlike the first guide member 400, the second guide member 600 and the third guide member 700 are fixed to the feeding frame 119.

The second guide member 600 is a guide member which is located further above than the separation nip in a vertical direction and is located upstream in the drawing direction of the cassette 106. The third guide member 700 is a guide member which is located further below than the separation nip in the vertical direction. When the feed roller 107 is viewed from a space 500 (see FIG. 11B) formed by drawing out the cassette 106, the second guide member 600 and the third guide member 700 are located in positions where the second guide member 600 and the third guide member 700 do not overlap with the feed roller 107. Since the second guide member 600 and the third guide member 700 exert less influence on the visibility of the rollers than the first guide member 400 exerts thereon, the second guide member 600 and the third guide member 700 are not required to be formed of a transparent resin material. Therefore, in the present embodiment, the second guide member 600 and the third guide member 700 are formed of a resin material whose light transmittance of the light having the wavelength of 360 nm to 420 nm is less than 80%. For example, the second guide member 600 and the third guide member 700 are formed of synthetic resin such as ABS resin, which is a comparatively inexpensive material.

[Cassette]

Figure 5:
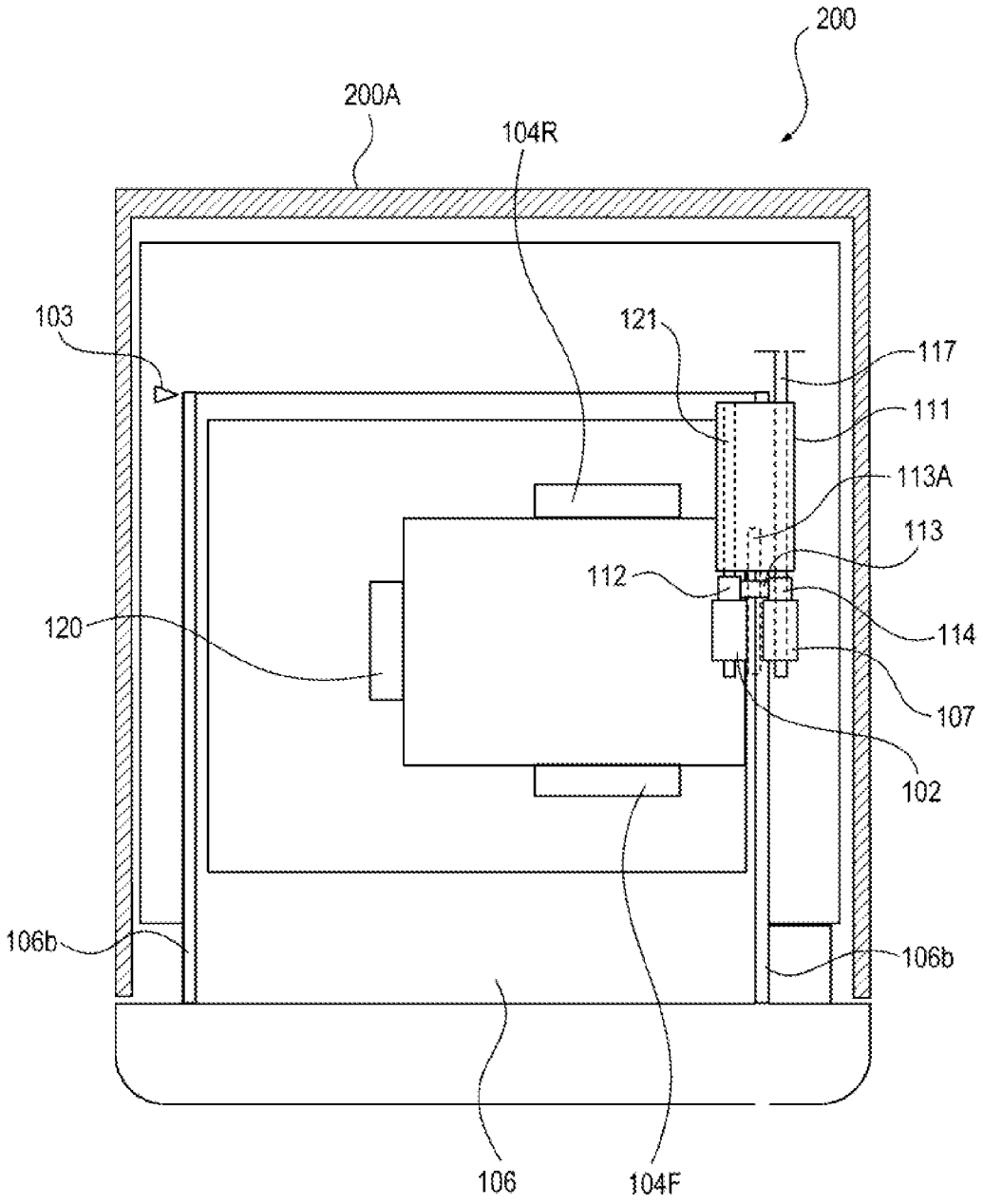
FIG. 5 is a top view showing the sheet feeding device.
Figure 6:
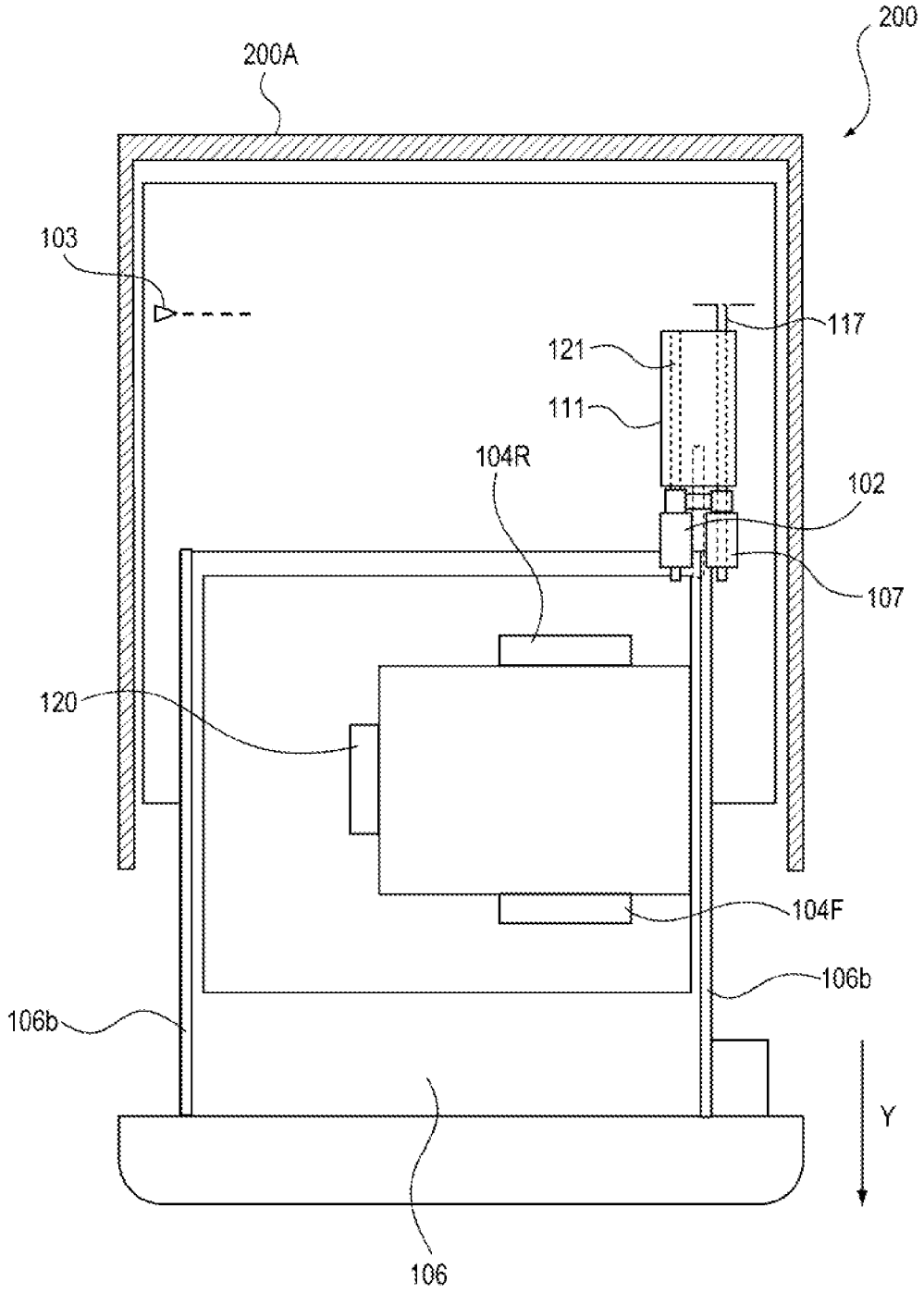
FIG. 6 is a top view showing the sheet feeding device.
Figure 7:
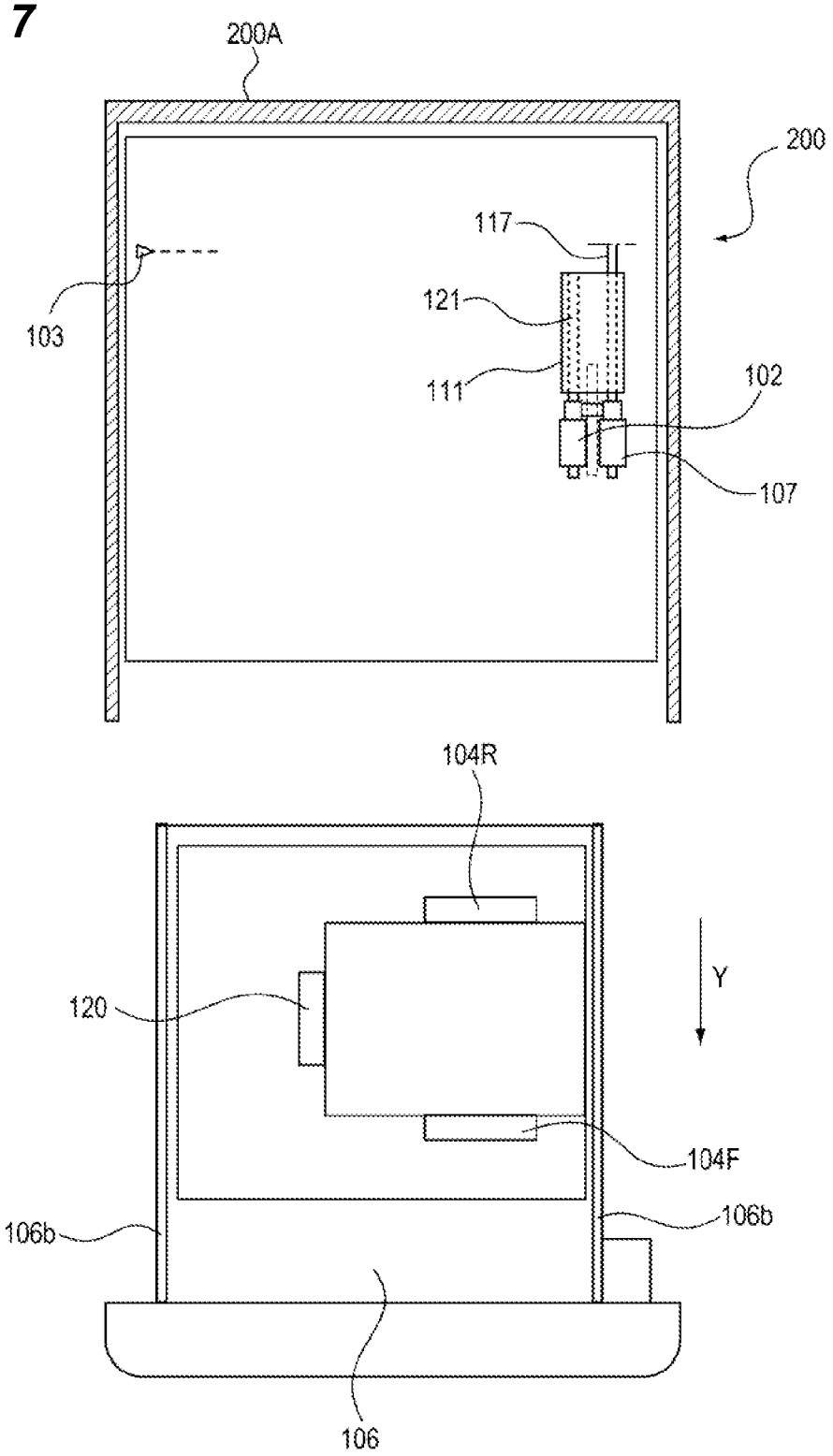
FIG. 7 is a top view showing the sheet feeding device.
Figure 8:
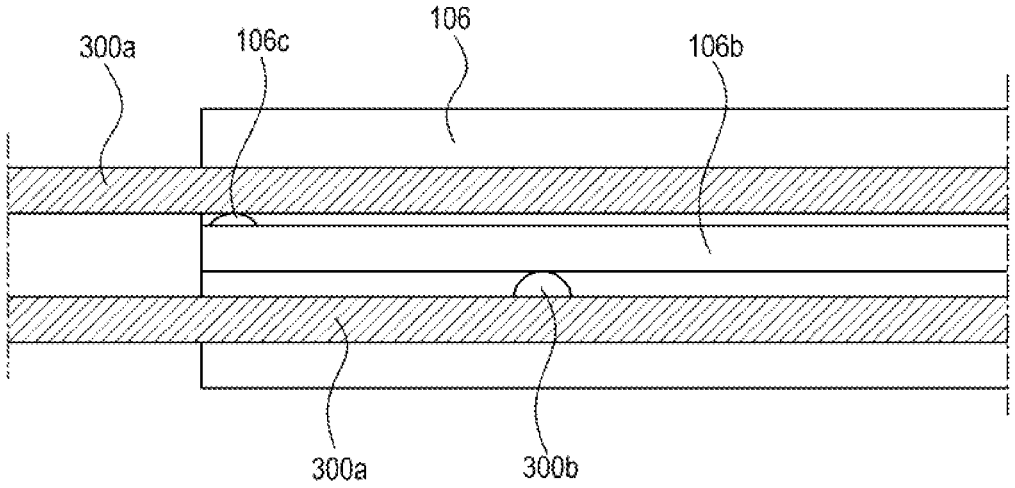
FIG. 8 is a view showing a state in which a storage is supported in the image forming apparatus.

With reference to FIGS. 5, 6, 7, and 8, a configuration of a cassette 106 in a sheet feeding portion 100 will be described further in detail. FIGS. 5, 6, and 7 are top views showing the sheet feeding portion, viewed from an arrow B direction shown in FIG. 2. FIG. 8 is a side view showing a part of the sheet feeding portion, viewed from an arrow E direction shown in FIG. 1, and is also a view showing a state in which the cassette 106 is supported in the image forming apparatus.

The cassette 106 is provided with side end regulating plates 104F and 104R and a rear end regulating plate 120 for regulating a position of the sheet S set on the tray 105 in a movable manner. The side end regulating plates 104F and 104R are provided in a movable manner in a width direction orthogonal to the feeding direction of the sheet. The rear end regulating plate 120 is provided in a movable manner in the feeding direction of the sheet. Accordingly, in accordance with a size of the sheet stored in the cassette 106, the side end regulating plates 104F and 104R are moved in the width direction, whereby positions of end portions of the sheet in the width direction can be regulated by the side end regulating plates 104F and 104R, and the rear end regulating plate 120 is moved in the feeding direction, whereby a position of an end portion of the sheet on an upstream side in the feeding direction can be regulated by the rear end regulating plate 120.

In addition, the cassette 106 is provided with a cassette rail 106*b* such that the cassette 106 is supported in a drawable manner with respect to the apparatus main body 200A. The cassette rail 106*b* is provided with a rail roller 106*c* in a rotatable manner. In addition, the apparatus main body 200A of the image forming apparatus 200 is provided with a pair of supporting rails 300*a* and 300*a* such that the top and bottom of the cassette rail 106*b* provided for the cassette 106 are sandwiched between the pair of supporting rails 300*a* and 300*a*. The supporting rail 300*a* of the pair of supporting rails 300*a* and 300*a*, which is located on a lower side of the rail 106*b*, is provided with a supporting rail roller 300*b* in a rotatable manner, which contacts a lower surface of the cassette rail 106*b* and rotates. The rail roller 106*c* provided for the cassette rail 106*b* contacts the storage supporting rail 300*a* of the pair of supporting rails 300*a* and 300*a* in a rotatable manner, which is located on an upper side of the cassette rail 106*b*. The cassette rail 106*b* is sandwiched between the pair of storage supporting rails 300*a* and 300*a*, whereby the cassette 106 is supported to the apparatus main body 200A of the image forming apparatus 200 in the drawable manner. The cassette rail 106*b* and the pair of storage supporting rails 300*a* and 300*a* are provided along an axial direction of the driving shaft 117 which supports the feed roller 107. Accordingly, the cassette 106 is provided in a manner drawable in the axial direction of the driving shaft 117 of the feed roller 107 with respect to the apparatus main body 200A.

As shown in FIG. 5, upon forming an image, the cassette 106 is stored inside the apparatus main body 200A of the image forming apparatus 200. When the sheet S is set inside the cassette 106, the cassette 106 is drawn out in an arrow Y direction from the apparatus main body 200A and is moved to a sheet setting position shown in FIG. 6. At this time, the rail roller 106*c* provided for the cassette rail 106*b* contacts the storage supporting rail 300*a* located on the upper side and is rotated, and the storage supporting rail roller 300*b* provided for the storage supporting rail 300*a* located on the lower side contacts the cassette rail 106*b* and is rotated. Thus, the cassette 106 is drawn out with low resistance against the apparatus main body 200A and is moved to the sheet setting position shown in FIG. 6. When the cassette 106 is further drawn out from the apparatus main body 200A, as shown in FIG. 7, the cassette 106 can be detached from the apparatus main body 200A of the image forming apparatus. In addition, inside the apparatus main body 200A of the image forming apparatus, a storage detection sensor 103 which detects whether the cassette 106 is stored inside the apparatus main body 200A is disposed.

[Feeding Unit]

Next, with reference to FIGS. 2, 3, and 9, a configuration and operation of the feeding unit which includes the pickup roller 102, the feed roller 107, and the retard roller 108 will be described further in detail. FIG. 9 is a perspective view showing a configuration of the vicinity of the rollers in the feeding unit.

A driving force (rotating force) is transmitted to the driving shaft 117 by a feeding driving motor and the drive transmission portion, which are not shown, whereby the feed roller 107 is rotated in a direction in which a sheet is fed. The retard roller 108 is pressed against the feed roller 107, thereby forming a separation nip. The retard roller 108 receives a torque in a direction opposite to a sheet feeding direction via a torque limiter, not shown. A torque value of this torque limiter is set to be larger than a value of a frictional force between a sheet and a sheet and smaller than a value of a frictional force between the sheet and the feed roller 107. Thus, when the number of the sheet entering the separation nip between the feed roller 107 and the retard roller 108 is one or no sheet enters the separation nip therebetween, the retard roller 108 is co-rotated with the feed roller 107. On the other hand, when the number of sheets entering the separation nip between the feed roller 107 and the retard roller 108 is two or more, a force in the direction opposite to the feeding direction is exerted on the retard roller 108 due to working of the torque limiter, thereby separating the sheets one by one. In other words, when a plurality of sheets is fed by the pickup roller 102, the retard roller 108 separates one sheet from the other sheets contacting the feed roller 107.

In addition, an idler gear 114 is supported to the driving shaft 117 of the feed roller 107. The rotating force transmitted to the driving shaft 117 of the feed roller 107 rotates the idler gear 114 which rotates in conjunction with the driving shaft 117. The lifting and lowering plate 111 is supported to the driving shaft 117 in a rotatable (swingable) manner. Although the description is given later, the supporting shaft 121 which supports the pickup roller 102 in a rotatable manner is supported to the lifting and lowering plate 111, and the pickup roller 102 is supported by the lifting and lowering plate 111 in a rotatable (swingable) manner with the driving shaft 117 as a center. In addition, the lifting and lowering plate 111 is provided with an idler shaft 113A which supports an idler gear 113 which engages with the idler gear 114 supported to the driving shaft 117. Furthermore, the supporting shaft 121 which supports the pickup roller 102 is supported to the lifting and lowering plate 111 as described above. An idler gear 112 which engages with the idler gear 113 is supported to the supporting shaft 121 of the pickup roller 102. Accordingly, the rotating force transmitted to the driving shaft 117 of the feed roller 107 from the feeding driving motor, not shown, is transmitted to the idler gear 114 and is further transmitted via the idler gear 113 to the idler gear 112. The rotating force transmitted to the idler gear 112 is transmitted from the idler gear 112 to the pickup roller 102 by a coupling mechanism 112A and rotates the pickup roller 102. The driving force (rotating force) is transmitted to the pair of conveying rollers 11 located downstream of the feed roller 107 by a conveyance driving motor and the drive transmission portion, which are not shown, whereby the pair of conveying rollers 11 are rotated in the direction in which the sheet is conveyed.

[Configuration of Attachment and Detachment of Rollers]

Figure 10A:
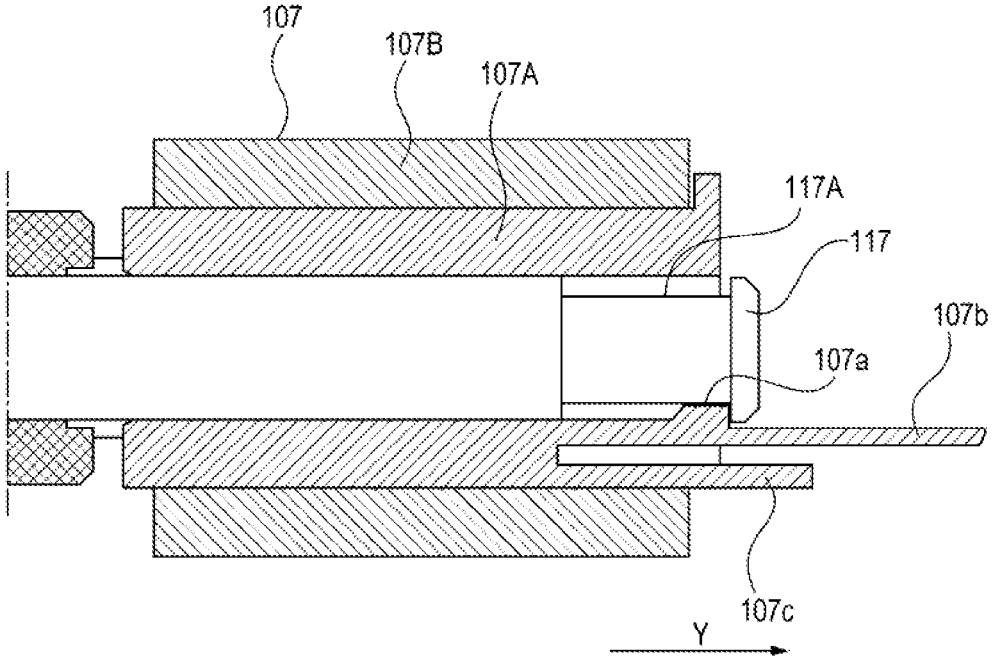
FIGS. 10A and 10B are cross-sectional views showing a feeding roller.
Figure 10B:
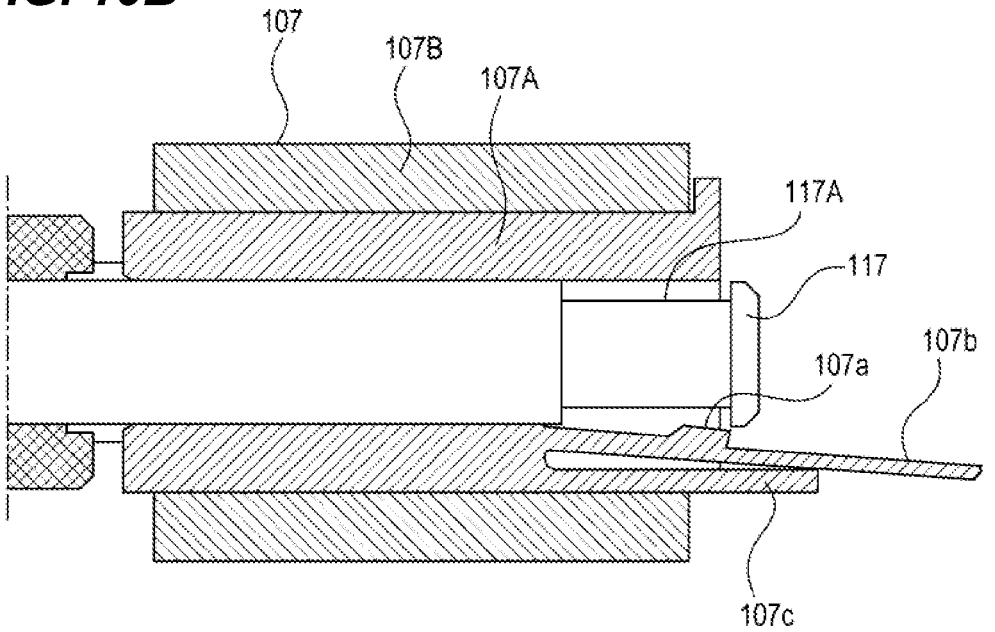

Next, with reference to FIGS. 9 and 10, a configuration of attachment and detachment of rollers of a feeding unit will be described. A pickup roller 102, a feed roller 107, and a retard roller 108 which constitute the feeding unit 10 are provided in a detachably attachable manner to the apparatus main body 200A. Here, as an example, the feed roller 107 will be described in an illustrative manner. FIGS. 10A and 10B are cross-sectional views showing the feed roller 107.

On a peripheral surface of an end portion on the other end side of a driving shaft 117 which is a supporting shaft of the feed roller 107, an engaging groove 117A which is a groove portion is formed. The feed roller 107 is constituted of a core portion 107A which is formed of resin and an outer peripheral portion 107B which is provided on an outer side of the core portion 107A, is formed of rubber, and abuts against a sheet S. The core portion 107A has an engaging projection 107*a*, a disengaging portion 107*b*, and a handle portion 107*c*. Here, the core portion 107A is an integrally molded component, having the engaging projection 107*a*, the disengaging portion 107*b*, and the handle portion 107*c*. The disengaging portion 107*b* is provided with the engaging projection 107*a* which is engageable or disengageable with the engaging groove 117A when the engaging projection 107*a* is elastically deformed by a user. The disengaging portion 107*b* is provided in such a way as to extend from the engaging projection 107*a* toward the other end side of the driving shaft 117. The handle portion 107*c* is provided on a further outer side than the engaging projection 107*a* with respect to a rotation center of the feed roller 107. Accordingly, with the engaging projection 107*a* of the core portion 107A engaged with the engaging groove 117A of the driving shaft 117, the feed roller 107 is inhibited from slipping out of the driving shaft 117. On the other hand, for example, in a state in which a user presses the handle portion 107*c* with his or her one finger, the user elastically deforms the disengaging portion 107*b* toward an outer side in a radial direction with his or her other finger, whereby the engagement of the engaging projection 107*a* with the engaging groove 117A is disengaged and the feed roller 107 can be detached from the driving shaft 117. It is to be noted that since a configuration in which each of the pickup roller 102 and the retard roller 108 is detached is the same as the configuration in which the feed roller 107 is detached, description therefor is omitted.

Figure 13:
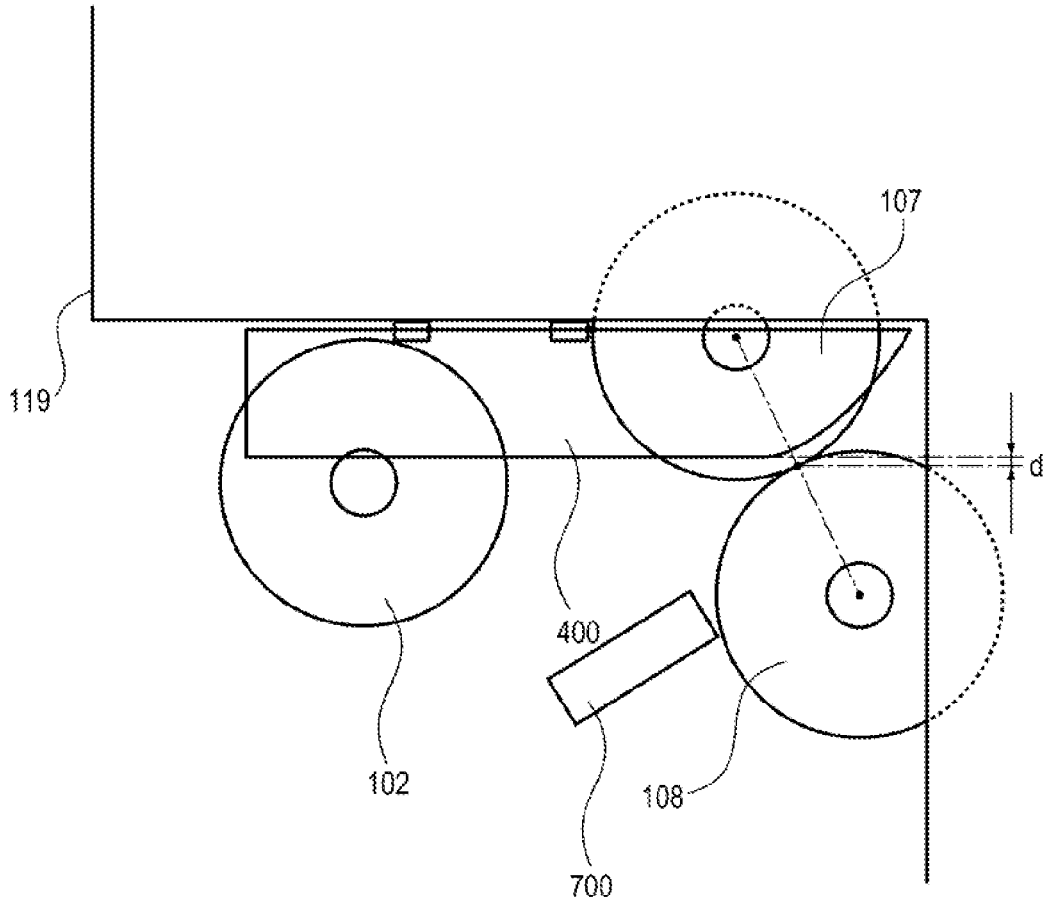
FIG. 13 is a view showing the vicinity of the rollers in the feeding unit, viewed from a space shown in FIG. 11B.

Next, with reference to FIGS. 11 and 13, a configuration, in which each roller is replaced, characterizes the present embodiment will be described. FIGS. 11A, 11B, and 11C are cross-sectional views showing a state of the cassette 106 and the feeding unit 10, viewed from an arrow C direction shown in FIG. 2. FIG. 13 is a view showing the vicinity of the rollers of the feeding unit in a space, viewed from an arrow D direction in FIG. 11B.

Figure 11A:
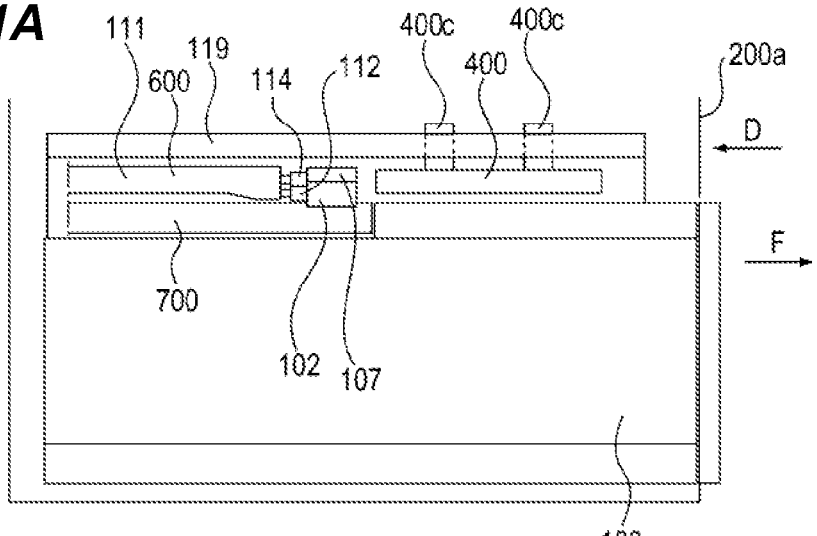
FIGS. 11A, 11B, and 11C are views showing a state of the storage and the feeding unit, viewed from an arrow C direction shown in FIG. 2.
Figure 11B:
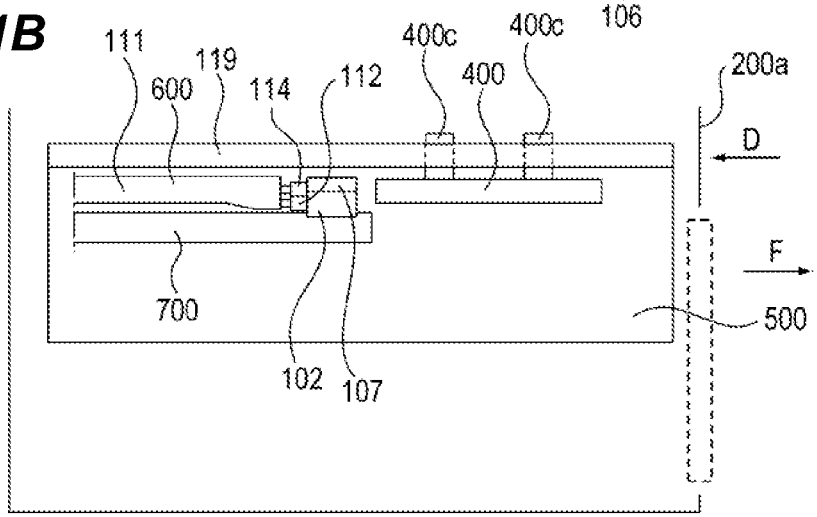
Figure 11C:
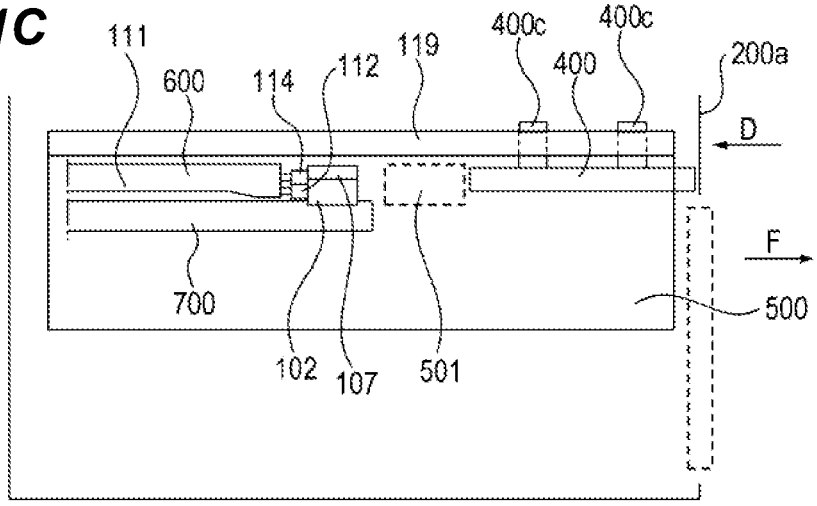

A user draws the cassette 106 from the apparatus main body 200A of the image forming apparatus, thereby changing a state shown in FIG. 11A to a state shown in FIG. 11B. Hereupon, each of the rollers of the feeding unit 10 comes to be accessible from an internal space 500 of the apparatus main body, which is formed by drawing the cassette 106 therefrom.

As shown in FIG. 13, in order to prevent failure in sheet feeding such as turning-up of a leading edge of a sheet caused when the sheet runs into the feed roller 107, a distance d between the first guide member 400 and a position of the nip formed between the feed roller 107 and the retard roller 108 is made small. Therefore, when the internal space 500 of the apparatus main body 200A is viewed from a side on which the cassette 106 is drawn out, in particular, a large part (at least half or more of area) of the feed roller 107 is in positional relationship in which the large part thereof is hidden by the first guide member 400. Therefore, in the present embodiment, as described above, as the material of the first guide member 400, the transparent acrylic resin is used. This material has the property which is the light transmittance of light having the wavelength of 360 nm to 420 nm is 80% or more. Thus, when a user views the internal space 500 of the apparatus main body 200A from the side on which the cassette 106 is drawn out, even when the first guide member 400 is present in front of the feed roller 107, the whole of the feed roller 107 is easily viewed through the transparent first guide member 400.

In addition, color of each of the engaging projection 107*a*, the disengaging portion 107*b*, and the handle portion 107*c* (see FIG. 10) provided for the core portion of the feed roller 107 is different from color of the feeding frame 119 of the feeding unit 10 included in the apparatus main body. In the present embodiment, the feeding frame 119 is formed of synthetic resin material such as ABS resin, whose color is black and light transmittance of light having a wavelength of at least 360 nm to 420 nm is less than 80%. Each of the engaging projection 107*a*, the disengaging portion 107*b*, and the handle portion 107*c* provided for the core portion of the feed roller 107 is formed of a resin material whose color is white. Thus, each of the rollers, which is required to be replaced, can be made conspicuous as contrasted with the feeding frame 119, thereby further enhancing visibility.

As described above, according to the present embodiment, the first guide member 400 is formed of the acrylic resin material whose light transmittance of the light having the wavelength of 360 nm to 420 nm is 80% or more. Therefore, after drawing out the cassette 106 from the apparatus main body 200A, each of the rollers (such as the pickup roller 102 and the feed roller 108) which is targeted for replacement can be easily visually recognized. After the roller to be replaced has been visually recognized, as shown in FIG. 11C, the first guide member 400 is drawn in an arrow F direction, thereby allowing the space 501 required to attach or detach the roller to be ensured.

In addition, in the present embodiment, the example in which the first guide member 400 is formed of the transparent resin material is described. However, the first guide member 400 may be formed of two members which are a transparent resin material and a non-transparent resin material. For example, only the guide portion 400*a* of the first guide member 400 may be formed of the acrylic resin which is the transparent resin material, and the handle portion 400*b* grasped upon sliding the first guide member 400 may be formed of the non-transparent resin material. The guide portion 400*a* and the handle portion 400*b* are formed as described above, thereby enhancing the visibility of the rollers and allowing a position of the handle portion 400*b*, which does not influence the visibility of the rollers, to be made conspicuous. In addition, only portions of the guide portion 400*a*, which are close to the rollers 102 and 107, may be formed of the transparent resin material, and a portion of the guide portion 400*a*, which is close to the handle portion 400*b*, may be formed of the non-transparent resin material.

In addition, both or at least one of the core portion 107A and the outer peripheral portion 107B of the feed roller 107 are or is formed of a material having chromatic color, thereby also allowing the visibility of the rollers to be enhanced.

In addition, although in the embodiment descried hereinbefore, as the image forming apparatus, the printer is illustrated as the example, the present invention is not limited to this. For example, the image forming apparatus may be other image forming apparatus such as a copying machine and a facsimile apparatus or may be other image forming apparatus such as a multifunction machine having the above-mentioned functions combined therein. In addition, although the image forming apparatus in which the intermediate transfer member is used, the toner images having the respective colors are transferred to the intermediate transfer member in a sequentially superimposed manner, and the toner images carried on the intermediate transfer member are collectively transferred to the sheet is illustrated as the example, the present invention is not limited to this. The image forming apparatus according thereto may be an image forming apparatus in which a sheet carrier is used and the toner images having the respective colors are transferred in a sequentially superimposed manner onto a sheet carried on the sheet carrier. The present invention is applied to a sheet feeding device used in each of these image forming apparatuses, thereby allowing similar effects to be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-161729, filed Sep. 5, 2019, which is hereby incorporated by reference herein in its entirety.

What is claimed is:

1. An image forming apparatus comprising:

an image forming portion which forms an image on a sheet;

a cassette which stores a sheet;

a pickup roller which picks up the sheet inside the cassette;

a feed roller which feeds the sheet picked up by the pickup roller toward the image forming portion and is attached to one end of a shaft;

a separation member which is provided in a position facing the feed roller, forms a separation nip by being pressed against the feed roller, and separates a plurality of sheets picked up by the pickup roller one by one at the separation nip;

a rail which supports the cassette and along which the cassette is drawn in a drawing direction orthogonal to a conveying direction; and a conveying guide which guides the sheet picked up by the pickup roller to the separation nip, the conveying guide including:

a first guide member which is located above the separation nip in a vertical direction and is located further downstream of the cassette in a drawing direction than the feed roller;

a second guide member which is located above the separation nip in the vertical direction and is located further upstream of the cassette in the drawing direction than the feed roller; and a third guide member which is located below the separation nip in the vertical direction and is located in a position where the third guide member overlaps with the feed roller in the drawing direction, the first guide member being configured to be slidable in the drawing direction when the feed roller is detached from the shaft and being formed of a material whose property of light transmittance of light having a wavelength of 360 nm to 420 nm is 80% or more, each of the second and third guide members being formed of a material whose light transmittance of the light having the wavelength of 360 nm to 420 nm is less than 80%, the feed roller being detachable from the one end of the shaft in a state in which the cassette is drawn out along the rail and the first guide member is slid in the drawing direction.

2. The image forming apparatus according to claim 1, further comprising a feeding frame which supports the first guide member in a slidable manner, wherein the feeding frame is formed of a material whose light transmittance of the light having the wavelength of 360 nm to 420 nm is less than 80%.

3. The image forming apparatus according to claim 1, wherein the first guide member has a handle portion which is operated by a user when the feed roller is replaced and a portion which is rubbed by the conveyed sheet, the portion being rubbed by the conveyed sheet is formed of a resin material whose property of light transmittance of the light having the wavelength of 360 nm to 420 nm is 80% or more, and the handle portion is formed of a material whose light transmittance of the light having the wavelength of 360 nm to 420 nm is less than 80%.

4. The image forming apparatus according to claim 1, wherein the pickup roller is supported by the one end of the shaft in a detachably attachable manner and is detachable from the side of the one end of the shaft in the state in which the cassette is drawn out along the rail and the first guide member is slid in the drawing direction.

5. The image forming apparatus according to claim 1, wherein the feed roller includes a core portion which is formed of resin and an outer peripheral portion which is wound around the core portion, is formed of a rubber material, abuts against the sheet, and has chromatic color.

* * * * *